US005087165A

United States Patent [19]

Akel

[11] Patent Number: 5,087,165

[45] Date of Patent: Feb. 11, 1992

[54] GOLF BALL RETRIEVER

[76] Inventor: Fred A. Akel, 55 S. Roscoe Blvd., Ponte Vedra Beach, Fla. 32082

[21] Appl. No.: 533,927

[22] Filed: Jun. 6, 1990

[51] Int. Cl.[5] ..... B60P 1/00

[52] U.S. Cl. ..... 414/440; 56/328.1; 414/507

[58] Field of Search ..... 414/338, 434, 437, 439, 414/440, 467, 501, 507; 56/328.1; 180/76

[56] References Cited

U.S. PATENT DOCUMENTS

| | | | |
|---|---|---|---|
| 2,365,540 | 12/1944 | Fonken | 414/440 |
| 2,658,637 | 11/1953 | Bailey | 414/440 |
| 3,102,647 | 9/1963 | Bonney | 414/440 |
| 3,175,714 | 3/1965 | Wittek | 414/440 |
| 3,306,480 | 2/1967 | Wysong | 414/440 |
| 3,613,341 | 10/1971 | Reeves | 414/440 X |
| 3,784,037 | 1/1974 | Woodall | 414/440 |
| 3,788,506 | 1/1974 | Lee | 414/440 |
| 3,856,165 | 12/1974 | Gustafson et al. | 414/440 |
| 3,995,759 | 12/1976 | Hollrock et al. | 414/440 |
| 4,158,418 | 6/1979 | Hayashi | 414/440 |
| 4,318,654 | 3/1982 | Lee | 414/440 |
| 4,792,271 | 12/1988 | Akel | 414/440 |

*Primary Examiner*—Robert J. Spar
*Assistant Examiner*—Robert S. Katz
*Attorney, Agent, or Firm*—Arthur G. Yeager

[57] ABSTRACT

Apparatus having a frame and an axle on which are two ground engaging wheels and in between the wheels is a plurality of spaced discs arranged to wedge golf balls between adjacent discs and to discharge those golf balls into a forward basket; half of the discs and wheels being in one of two separately rotatable sections mounted on the same axle, the wheels being slightly larger in diameter than the ball engaging discs and capable of functioning as load supporting wheels located at the ends of the axle, but inside the frame.

20 Claims, 3 Drawing Sheets

GOLF BALL RETRIEVER

BACKGROUND OF THE INVENTION

With the widespread use of golf driving ranges there has come a need for devices that can rapidly pick up golf balls lying on the ground over a sizeable area of several acres. It is necessary for the proprietor of such a range to pick up hundreds or thousands of golf balls several times a day, wash them, and package them for reuse. Many different types of apparatus have been suggested although all generally involve a wheeled cart that can be rolled over the area, preferably pushed by a small electric or gasoline powered vehicle driven by a person. The method of picking up the balls has taken many different designs, although the most popular seem to be those shown in U.S. Pat. Nos. 2,365,540; 3,630,401; and 3,856,165. The varieties of design have been numerous, but there remained several reasons why improvements were still necessary. For example, some designs were too heavy and tended to mash some golf balls into the ground instead of picking them up. Other designs did not pick up enough golf balls in one pass over the area, and therefore, were not efficient. My patent U.S. Pat. No. 4,792,271 solves these problems by providing a novel, efficient, light weight retrieval device. Subsequent research, however, has lead to still further improvements.

It is an object of this invention to provide a novel and efficient apparatus for picking up large numbers of golf balls in one sweep of the area and which may be turned with ease. It is another object of this invention to provide an improved light weight golf ball retriever. A further object is to provide improved wheels to such retriever which wheels are protected and are part of the pick-up capability of the retriever. Still other objects will become apparent from the more detailed description which follows.

BRIEF SUMMARY OF THE INVENTION

This invention relates to a golf ball retrieving apparatus comprising a frame supported by an axle means and two ground engaging wheels mounted on opposite end portions of the axle means, a plurality of spaced generally rigid disc members mounted on the axle means between and laterally spaced inwardly from the wheels and adapted to turn respectively with the wheels. The disc members having a diameter less than the diameter of the wheels thereby spacing the outer edges of the disc members upwardly from the ground so that the outer edges do not engage the ground. A plurality of spaced, stationary fingers extend inwardly in the spaces between adjacent disc members with their fixed ends forward of the disc members and their free ends between the disc members, and basket means are located forward of the disc members adapted to catch balls stripped from between adjacent disc members by the fingers. The disc members are arranged in two substantially identical sections freely rotatable about the axle means with a substantially equal number of disc members in each section connected together by tie rod means adapted to cause all the disc members in one section to rotate together around the axle means independent of the rotation of the other section.

In specific and preferred embodiments of the invention the basket is removable from the frame to be emptied; the wheels are similar to the disc members except to be larger in diameter and thicker than the disc member and are located inside the perimeter of the frame; and the apparatus may be fitted with a guide wheel and a handle to be operated by a person pushing it from behind, or it may be joined to two or more others of such apparatus units to form a gang retrieval apparatus that may be pushed from behind by a power vehicle such as a tractor.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
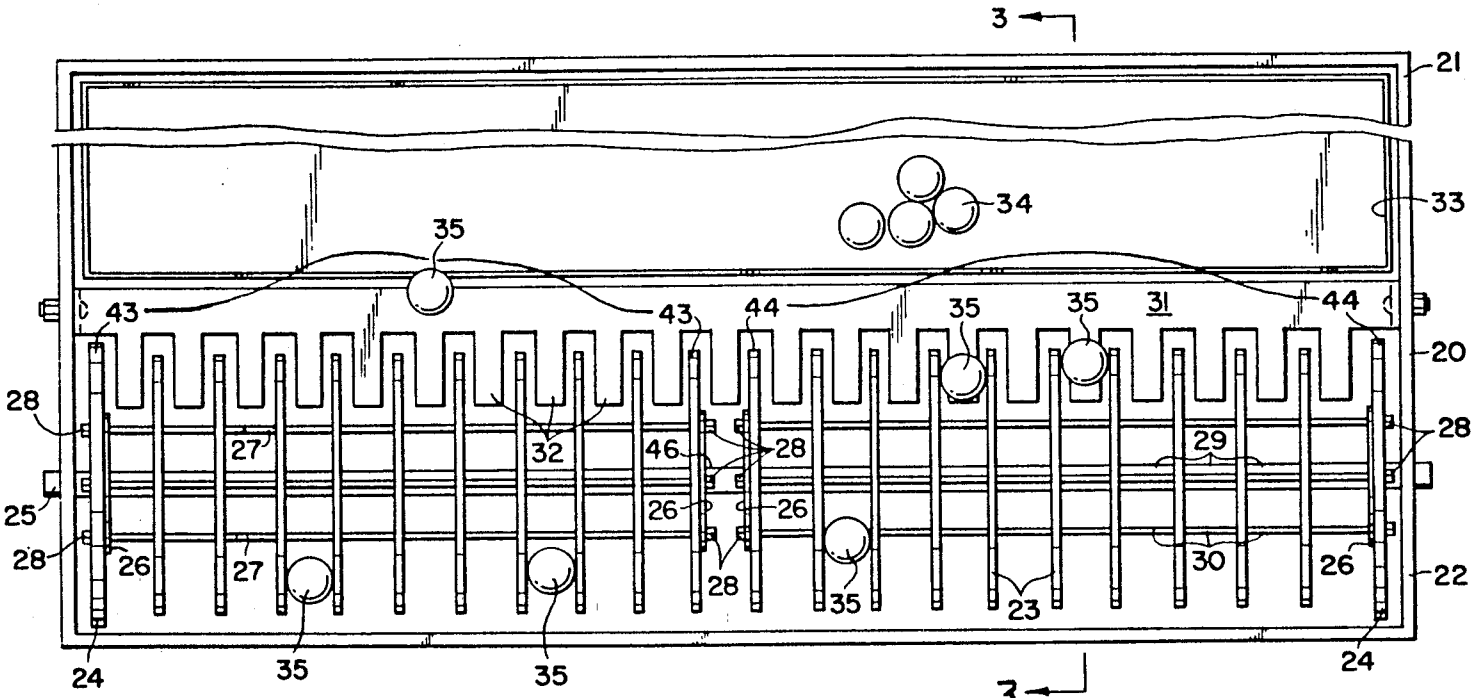
FIG. 1 is a top plan view of the apparatus of this invention.

The features of the golf ball retrieving apparatus of this invention are best understood by reference to the attached drawings.

The apparatus unit of this invention includes a frame 20 having a forward portion 21 and a rearward portion 22 mounted on a laterally extending elongated axle 25. Forward section 21 contains a removable basket 33 to collect golf balls 34; and rearward section 22 houses axle 25 and the apparatus for picking golf balls up from the ground and delivering them for discharge into basket 33. The apparatus for picking up golf balls from the ground includes a plurality of disc members 23 which are spaced apart slightly less than the diameter of a golf ball, and which are sufficiently flexible to permit a golf ball to be wedged between two adjacent disc members 23 as at 35 and yet be sufficiently rigid as to retain that golf ball by frictional engagement between adjacent disc members 23. At the outer extremities of the plurality of disc members 23 are two ground engaging wheels 24 affixed to axle 25 so as to rotate with the rotation of shaft 25. Wheels 24 rest on the ground and are turned by friction between the ground and the wheels 24 as the apparatus is moved across the ground. Disc members 23 are slightly smaller in diameter than wheels 24 and therefore do not touch the ground.

Disc members 23 and wheels 24 are divided into two substantially equal sized sections 43 and 44, such that each section includes half of the disc members 23 and one wheel 24. Each section 43 and 44 functions as a separate unit in rotating around shaft 25; i.e., they each rotate separately with no connection between the two sections except that they both rotate around a central axle 25. A single hollow sleeve 29 extends concentrically around shaft 25 through all of the disc members 23 and wheel 24 in one section 43 or 44, and a second such sleeve extends through all of the disc members and wheel in the other section 44 or 43. Between sections 43 and 44 there is a single spacer sleeve 46. The disc members 23 and the wheel 24 of each section 43 or 44 are connected together so that all elements rotate around axle 25 in the direction of arrow 45 by reason of a plurality (e.g., four as shown) of tie rods 27 extending through appropriate holes in each disc member 23 and wheel 24 and fastened with nuts 28. Between adjacent disc members 23 are hollow tubular spacer sleeves around each tie rod 27 between adjacent disc members 23 to maintain disc members 23 and wheels 24 parallel and perpendicular to axle 25 and allow nuts 28 to be tightened. In order to provide appropriate stiffness and backing for the forces generated in tightening nuts 28 it is preferred to employ support plates 26 at opposite ends or each of sections 43 and 44. Preferably sleeves 29 are provided with one or more grease fittings (not shown) to admit grease to lubricate the space between sleeve 29 and axle 25. The purpose for having two sections 43 and 44 is to provide a differential effect for ease in running the golf ball retrieval apparatus on an arcuate path wherein the outside section 43 or 44 is required to turn faster than the inside section 44 or 43. It may be seen that in this apparatus sections 43 and 44 may be rolled over the ground where there are golf balls to be picked up and many will be wedged between adjacent disc members and picked up from the ground.

The golf balls 35 that are caught between adjacent disc members 23 are discharged by the fingers 32 of finger plate 31 that extend inwardly between adjacent disc members 23. Fingers 32 are stationary, and as sections 43 and 44 rotate, golf balls 35 will be dislodged from between disc members 23 and directed into basket 33 in forward section 21 of the apparatus. Preferably balls 35 are discharged into a basket 33 which is readily removable from forward section 21. It is to be understood that basket 33 need not be removable, and furthermore, forward section 21 may be structured to hold two or more smaller baskets 33 rather than one larger basket 33.

Disc members 23 are preferably made of synthetic plastic materials such as polyolefins, polyacrylates, polyacetates, polyamides, polycarbonates, elastomeric materials, etc. The preferred material is polycarbonate. Wheels 24 may be made of metal rims and rubber tires, but it is preferred that wheel 24 be a slightly larger, thicker version of disc member 23 and made of the same material as disc member 23. This preferred structure provides the ability to pick up golf balls between the wheel 24 and the next adjacent disc member 23, and also the possibility of mounting wheel 24 inside the perimeter of frame 20. This arrangement saves space and weight, and maximizes the efficiency of the unit.

Figure 2:
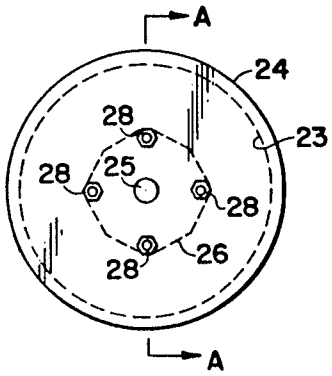
FIG. 2 is an end elevational view of the apparatus of FIG. 1.
Figure 3:
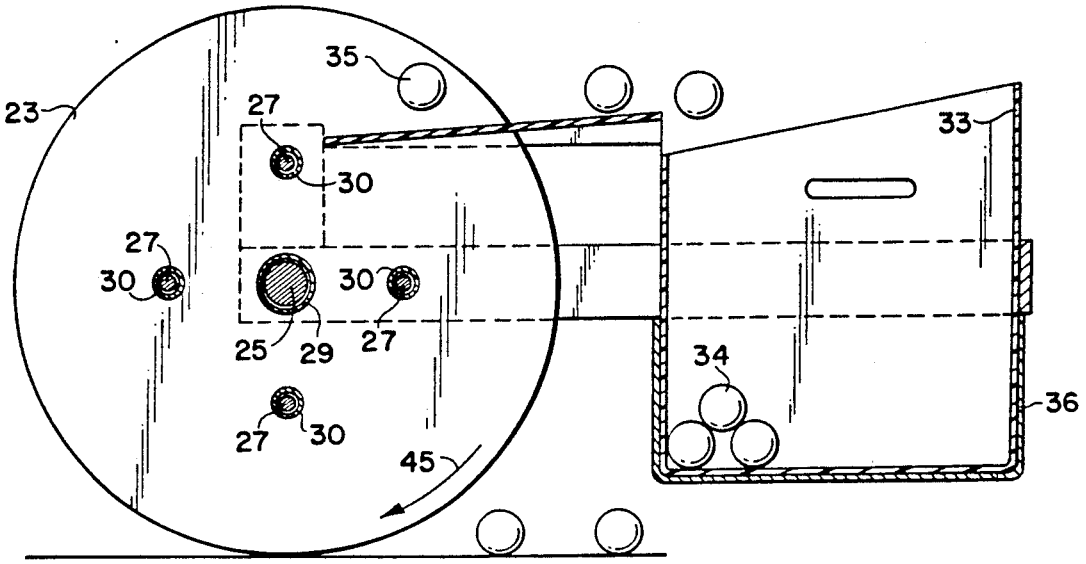
FIG. 3 is a cross sectional view taken at 3——3 of FIG. 1.
Figure 4:
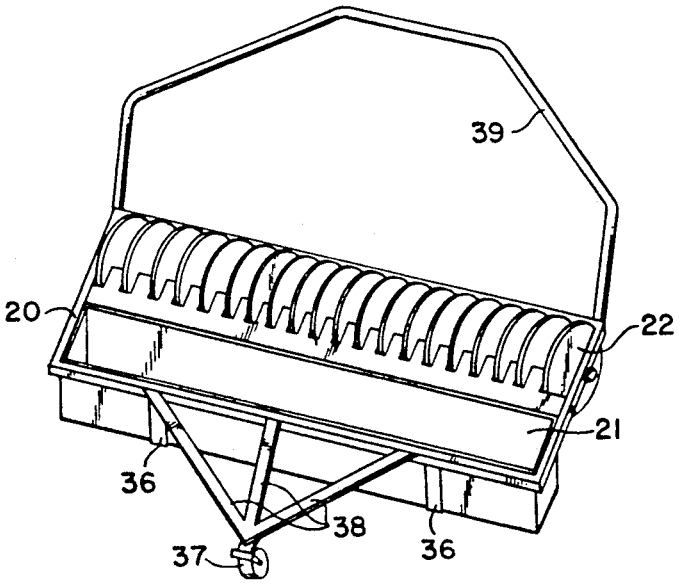
FIG. 4 is a perspective view of the apparatus of this invention assembled with a front guide wheel and a rear handle bar for pushing by a person on foot.

In FIG. 4 there is disclosed the use of a single apparatus unit, such as that described above and shown in FIGS. 1-3, for a person to push around in collecting golf balls. An extension triangular framework 38 is attached to the front of section 21, as by bolts and nuts, and a guide wheel 37 is rotatably affixed to the extension framework 38. A handle bar 39 is attached to the rear of rear section 22. In this form the apparatus unit may be pushed around like a lawn mower.

If a larger operation is preferred three or more of the units may be connected by a gang assembly frame 40. Rearwardly extending bars may be attached to a tractor or other power vehicle for pushing the entire assembly over the area for retrieving golf balls. More than three units may be employed by suitably enlarging framework 40. A pintle connection 42 for each unit is normally suitable for attaching each unit to the framework.

Figure 6:
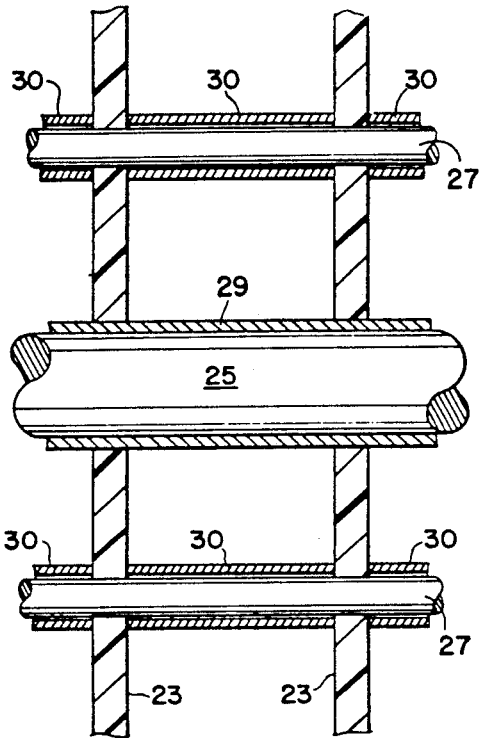
FIG. 6 is a cross section (enlarged) taken at A——A of FIG. 2 through two adjacent discs 23 in the center of section 44 or 45.
Figure 7:
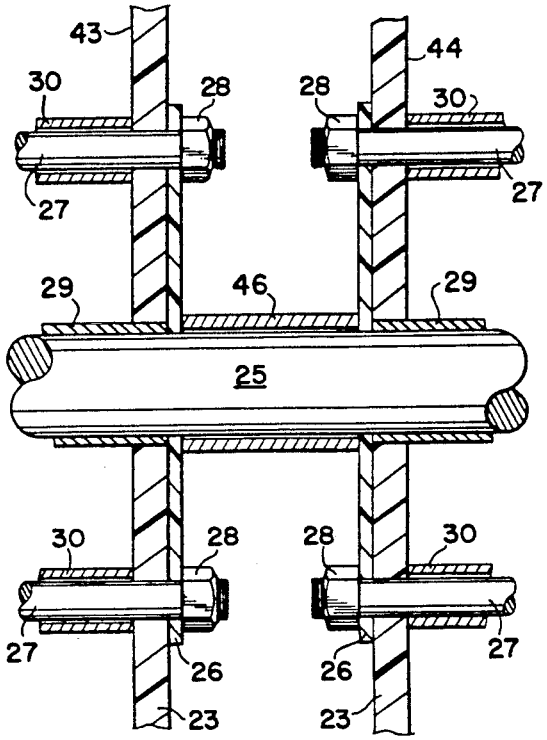
FIG. 7 is a cross section (enlarged) taken at A——A of FIG. 2 through the center of shaft 25 between sections 44 and 45.
Figure 5:
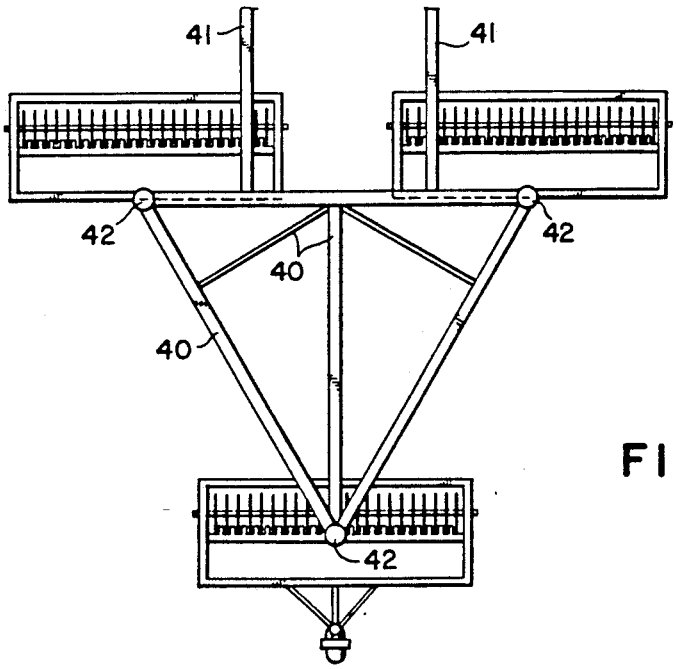
FIG. 5 is a top plan view of three units of the apparatus of this invention assembled in a gang arrangement to be pushed by a vehicle (not shown).

FIGS. 6 and 7 show in enlarged views how sleeve 29 fits closely around axle 25 except for the central space between sections 43 and 44 where a spacer sleeve 46 is located. This arrangement shows how sections 43 and 44 can rotate separately around axle 25. Spacers 30 around tie rods 27 maintain the proper spacing between adjacent disc members 23 for picking up golf balls. The ends of tie rods 27 are threaded and nuts 28 are tightened so as to make all of the disc members 23 in each section 43 and 44 rotate separately around shaft 25.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A golf ball retrieving apparatus comprising a frame supported by an elongated axle and two ground engaging wheels mounted on opposite end portions of said axle and having a space therebetween, a plurality of spaced generally rigid disc members mounted on said axle between and laterally spaced inwardly from and filling the space between said wheels, said disc members having a diameter less than the diameter of said wheels thereby spacing the outer edges of said disc members upwardly from the ground so that said outer edges do not engage the ground, a plurality of spaced, stationary elongated fingers having fixed ends connected to said frame and opposite free ends extending inwardly in the spaces between adjacent disc members with said fixed ends forward of said disc members and said free ends between said disc members, and basket means located forward of said disc members adapted to catch balls stripped from between adjacent disc members by said fingers, said disc members being arranged in two substantially identical sections each with a respective said wheel, each of said identical sections being freely rotatable about said axle with a substantially equal number of disc members in each said section, tie rod means connecting said disc members of respective said identical section to cause all said disc members on said section to rotate together with its said wheel around said axle independent of the rotation of another said section with its said wheel around said axle.

2. The apparatus of claim 1 wherein said basket means includes a removable basket resting in a receptacle in said frame.

3. The apparatus of claim 1 wherein said wheels comprise two discs made of substantially the same material as that of said disc members and being located at the two outer ends of said axle and said wheels being spaced apart from the next adjacent disc member so as to provide a lateral spacing which is substantially equal to the lateral spacing between adjacent disc members.

4. The apparatus of claim 3 wherein said frame includes an outer perimeter, said wheels being located inside said outer perimeter of said frame.

5. The apparatus of claim 1 wherein all of the disc members of one said section are located along one half of the axle from the lengthwise center of the axle to one end of the axle and all of the disc members of the other said section are located along the other half of the axle from said lengthwise center to the other end of the axle.

6. The apparatus of claim 5 further comprising two separate, concentric sleeves around the axle and extending substantially entirely over and connected to each said section lengthwise, respectively, and a concentric sleeve spacer over the outside of said axle between adjacent disc members at said lengthwise center.

7. The apparatus of claim 1 which additionally comprises a guide wheel located forwardly of said basket means and adapted to be in contact with the ground over which said apparatus travels; a rigid frame extension to which said guide wheel is rotatable attached; and a handle bar means attached to and extending rearwardly from said frame and adapted to be pushed in order to propel the apparatus over the ground.

8. The apparatus of claim 1 which additionally comprises a gang assembly framework for connecting three or more units of said apparatus in a triangular arrangement to cover a broader area than a single unit of said apparatus, said framework being attachable to each apparatus unit and to a powered propulsion means.

9. The apparatus of claim 1 wherein said disc members are made of polycarbonate.

10. The apparatus of claim 3 wherein said disc members and said wheels are made of polycarbonate.

11. A golf ball retrieving apparatus comprising a frame having an outer periphery and being supported by an axle having a ground engaging wheel in the form of a disc member at each end thereof inside said outer periphery, said frame having a rearward portion and a forward portion; located in said rearward portion a pair of spaced sleeves rotatable about said axle, a plurality of spaced generally rigid disc members mounted on respective said sleeve said wheels being respectively connected to respective said sleeves a plurality of lateral tie rods connecting said disc members attached to one said sleeve to one said wheel, another plurality of tie rods connecting said disc members attached to another said sleeve to another said wheel, so as to provide two substantially equal sections of said plurality of disc members and respective said wheel mounted on respective said sleeves, a spacer sleeve connected between said sections so as to permit rotation of said pair of spaced sleeves around said axle as separate units said spacer sleeve between said sections maintaining the same distance between said sections as the distance between adjacent disc members, each said section being rotatable independently of the other said section, said wheels being similar to said disc members except slightly larger in diameter and thicker than said disc members located in said forward portion a removable basket to receive golf balls discharged from said disc members; and finger means connected to said frame and extending into said rearward portion and between adjacent said disc members so as to dislodge a golf ball from between adjacent disc members as said disc members rotate toward said forward section and direct the dislodged ball into said basket.

12. The apparatus of claim 11 wherein said disc members and said wheels are made of polycarbonate.

13. A golf ball retrieving apparatus comprising a frame, elongated axle attached to said frame for supporting said frame, a pair of spaced ground engaging wheels mounted on opposite end portions of said axle, a plurality of spaced generally rigid laterally extending members generally equally divided into two sections and mounted on said axle between and laterally spaced inwardly from and between said wheels and adapted to turn respectively with its adjacent said wheel, said members extending radially less than the diameter of said wheels thereby spacing the outer free edges of said members upwardly from the ground so that said outer edges do not engage the ground, a plurality of spaced and stationary elongated fingers having fixed ends and extending to free ends respectively in spaces between adjacent pairs of members with said fixed ends being forward of said members and said free ends located between said members, and basket means positioned forward of said members adapted to receive balls stripped from between adjacent members by said fingers, said members being arranged in two substantially identical sections, freely rotatable about said axle, tie rods means connecting respective said wheel to a substantially equal number of members in each said section together to cause all said members on one said section to rotate together around said axle independent of the rotation of another said section.

14. The apparatus of claim 13 wherein said laterally extending members are discs and each said wheel includes a disc made of substantially the same material as that of said laterally extending members and being located at the two outer ends of said axle, each said wheel disc being spaced apart from the next adjacent disc member as the lateral spacing between adjacent disc members whereby golf balls may be trapped between said wheel disc and its adjacent said laterally extending member disc.

15. The apparatus of claim 14 wherein said frame includes an outer perimeter, said wheels being located inside said outer perimeter of said frame.

16. The apparatus of claim 13 wherein all of said members of one said section are located along one half of said axle from the lengthwise center of said axle to one end of said axle and all of said disc members of said other section are located along the other half of said axle from said lengthwise center to the other end of said axle.

17. The apparatus of claim 16 wherein said axle includes a rigid shaft, a pair of elongated concentric sleeves around said shaft and extending over each said section lengthwise, respectively, and a concentric sleeve spacer around said shaft between adjacent disc members on respective said sections, said elongated concentric sleeves being separately rotatably about said shaft via respective said wheel of respective said section.

18. The apparatus of claim 13 wherein each said wheel is spaced from an adjacent said member substantially the same as the spacing between adjacent said members whereby gold balls may be trapped between said wheel and its adjacent said member, said axle including a rigid shaft extending across and within said frame, a pair of sleeves rotatable independently on said shaft, said sleeves forming the bearing portion of respective said section, a spacer between said sleeves of respective said section located about said shaft.

19. The apparatus of claim 18 wherein said spacer is freely rotatable about said shaft upon rotation of both said sections, and permits independent rotation of each said section during turning movements of said apparatus or during traverse of varying ground condition beneath respective said sections.

20. The apparatus of claim 19 wherein said sections include metal plates facing each other and said spacer having opposite end portions engaging respective said metal plates.

* * * * *